US010766680B2

(12) United States Patent
Holley, Jr.

(10) Patent No.: US 10,766,680 B2
(45) Date of Patent: Sep. 8, 2020

(54) CARRIER FOR CONTAINERS

(71) Applicant: Graphic Packaging International, LLC, Atlanta, GA (US)

(72) Inventor: John Murdick Holley, Jr., Lawrenceville, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 56 days.

(21) Appl. No.: 16/045,939

(22) Filed: Jul. 26, 2018

(65) Prior Publication Data

US 2019/0047763 A1 Feb. 14, 2019

Related U.S. Application Data

(60) Provisional application No. 62/543,053, filed on Aug. 9, 2017.

(51) Int. Cl.

| | |
|---|---|
| ***B65D 71/24*** | (2006.01) |
| ***B65D 71/58*** | (2006.01) |
| ***B65D 5/50*** | (2006.01) |
| ***B31B 50/26*** | (2017.01) |

(52) U.S. Cl.

CPC ..... *B65D 71/243* (2013.01); *B31B 50/26* (2017.08); *B65D 5/5035* (2013.01); *B65D 71/0022* (2013.01); *B65D 2571/0066* (2013.01); *B65D 2571/00141* (2013.01); *B65D 2571/00388* (2013.01); *B65D 2571/00802* (2013.01)

(58) Field of Classification Search

CPC ..... B65D 71/243; B65D 71/24; B65D 2571/0066; B65D 2571/00388; B65D 2571/00141; B65D 71/0022; B65D 5/5035; B65D 2571/00802; B31B 50/26

USPC ..... 206/427, 162, 175, 180

See application file for complete search history.

(56) References Cited

U.S. PATENT DOCUMENTS

| | | | |
|---|---|---|---|
| 2,222,211 | A | 11/1940 | Arneson |
| 2,225,822 | A | 12/1940 | Crook |
| 2,227,330 | A | 12/1940 | Turner |
| 2,331,312 | A | 10/1943 | Dorfman |

(Continued)

FOREIGN PATENT DOCUMENTS

| | | |
|---|---|---|
| DE | 90 04 439 | 6/1990 |
| EP | 0 822 150 | 2/1998 |

(Continued)

OTHER PUBLICATIONS

International Search Report and Written Opinion for PCT/US2018/043819 dated Nov. 9, 2018.

*Primary Examiner* — Steven A. Reynolds

(74) *Attorney, Agent, or Firm* — Womble Bond Dickinson (US) LLP

(57) ABSTRACT

A carrier for holding at least one container includes a plurality of panels extending at least partially around an interior of the carrier, the plurality of panels includes a front panel, a back panel, at least one central panel, at least one side panel, and at least one bottom panel. At least one divider flap is foldably connected to one of the front panel and the back panel, the at least one divider flap folded away from the one of the front panel and the back panel to form at least one opening in the one of the front panel and the back panel, the at least one divider flap extends through the interior of the carrier to the at least one central panel.

49 Claims, 12 Drawing Sheets

(56) References Cited

U.S. PATENT DOCUMENTS 2,336,857 A 12/1943 Gies et al.
2,457,308 A 12/1948 Hall et al.
2,460,108 A 1/1949 Smith et al.
2,660,361 A 11/1953 Tyrseck
2,689,061 A 9/1954 Gray
2,721,001 A 10/1955 Hasselhoff
2,772,020 A 11/1956 Kramer
2,776,072 A 1/1957 Forrer
2,783,916 A 3/1957 Hodapp
2,991,908 A 7/1961 Conescu
2,993,619 A 7/1961 Arneson
3,029,977 A 4/1962 Arneson
3,053,411 A 9/1962 Struble et al.
3,128,906 A 4/1964 Forrer
3,190,487 A 6/1965 Wood
3,191,800 A 6/1965 Kowal
3,194,478 A 7/1965 Weiss
3,229,849 A 1/1966 Spillson
3,236,414 A 2/1966 Slevin, Jr.
3,254,758 A * 6/1966 Reynolds ..... B65D 75/54 229/203
3,313,466 A 4/1967 Keith
3,343,742 A 9/1967 Siegler
3,352,452 A 11/1967 Graser
3,432,073 A 3/1969 Forrer
3,554,401 A 1/1971 Wood
3,624,790 A 11/1971 Stout
3,651,982 A 3/1972 Slevin
3,661,297 A 5/1972 Wood
3,669,306 A 6/1972 Forrer
3,672,539 A 6/1972 Forrer
3,709,400 A 1/1973 Arneson
3,721,335 A 3/1973 Grant
3,722,738 A 3/1973 Wright
3,739,940 A 6/1973 Harrelson
3,754,680 A 8/1973 Wood
3,757,991 A 9/1973 Stout
3,784,053 A 1/1974 Stout
3,860,113 A 1/1975 Helms
3,893,565 A 7/1975 Rossi et al.
3,917,059 A 11/1975 Wood
3,917,060 A 11/1975 Wood
3,917,061 A 11/1975 Stout
4,000,813 A 1/1977 Stout
4,010,847 A 3/1977 Wood et al.
4,029,205 A 6/1977 Wood
4,153,158 A 5/1979 Graser et al.
4,171,046 A 10/1979 Bonczyk
4,187,944 A 2/1980 Wood
4,205,748 A 6/1980 Wilson
4,217,983 A 8/1980 Stout
4,243,138 A 1/1981 Wilson
4,250,992 A 2/1981 Gilbert
4,253,564 A 3/1981 Engdahl, Jr.
4,308,950 A 1/1982 Wood
4,318,470 A 3/1982 Montealegre
4,319,682 A 3/1982 Wright et al.
4,362,240 A 12/1982 Elward
4,374,561 A 2/1983 Stout et al.
4,377,252 A 3/1983 Schillinger
4,406,365 A 9/1983 Kulig
4,413,729 A 11/1983 Wood
4,450,956 A 5/1984 Wood
4,469,222 A 9/1984 Graser
4,480,746 A 11/1984 Wood
4,482,055 A 11/1984 Boyle
4,505,696 A 3/1985 Wright et al.
4,509,640 A 4/1985 Joyce
4,544,092 A 10/1985 Palmer
4,591,090 A 5/1986 Collins et al.
4,610,349 A 9/1986 Schwartz et al.
4,722,437 A 2/1988 Walsh
4,770,294 A 9/1988 Graser
4,782,943 A 11/1988 Blackman
4,782,944 A 11/1988 Engdahl, Jr.
4,792,038 A 12/1988 Cooper
4,927,009 A 5/1990 Stout
5,029,698 A 7/1991 Stout
5,040,672 A 8/1991 DeMaio et al.
5,072,876 A 12/1991 Wilson
5,123,588 A 6/1992 Harris
5,161,732 A 11/1992 Clein et al.
5,167,325 A 12/1992 Sykora
5,191,976 A 3/1993 Stout et al.
5,246,113 A 9/1993 Schuster
5,282,348 A 2/1994 Dampier et al.
5,359,830 A 11/1994 Olson et al.
5,363,954 A 11/1994 Dampier et al.
5,400,901 A 3/1995 Harrelson
5,439,110 A 8/1995 Regan, II
5,458,234 A 10/1995 Harris
5,482,203 A 1/1996 Stout
5,484,053 A 1/1996 Harris
5,499,712 A 3/1996 Harrelson
5,518,110 A 5/1996 Harrelson
5,531,319 A 7/1996 Harrelson
5,538,130 A 7/1996 Harrelson
5,538,131 A 7/1996 Harrelson
5,547,074 A 8/1996 Plaxico et al.
5,579,625 A 12/1996 Olson et al.
5,590,762 A 1/1997 Harrelson
5,593,027 A 1/1997 Sutherland
5,611,425 A 3/1997 Holley, Jr.
5,620,094 A 4/1997 Naumann
5,638,956 A 6/1997 Sutherland
5,645,162 A 7/1997 Harrelson
5,649,620 A 7/1997 Harrelson
5,657,864 A 8/1997 Harrelson
5,657,865 A 8/1997 Harrelson
5,680,930 A 10/1997 Stone
5,682,982 A 11/1997 Stonehouse
5,682,985 A * 11/1997 Plaxico ..... B65D 71/0022 206/193
5,695,051 A 12/1997 Hart
5,709,298 A 1/1998 Harris
5,765,685 A 6/1998 Roosa
5,775,487 A 7/1998 Harrelson
5,819,920 A 10/1998 Sutherland
5,848,695 A 12/1998 Harris et al.
5,855,316 A 1/1999 Spivey
5,871,090 A 2/1999 Doucette et al.
5,878,877 A 3/1999 Sutherland
5,884,756 A 3/1999 Holley, Jr. et al.
5,941,377 A 8/1999 Hart et al.
5,947,273 A 9/1999 Dalrymple et al.
6,003,665 A 12/1999 Stout
6,041,920 A 3/2000 Hart et al.
6,112,977 A 9/2000 Sutherland et al.
6,131,729 A 10/2000 Eckermann et al.
6,155,962 A 12/2000 Dalrymple et al.
6,168,013 B1 1/2001 Gomes
6,230,881 B1 5/2001 Collura
6,247,585 B1 6/2001 Holley, Jr.
6,315,111 B1 11/2001 Sutherland
6,321,906 B1 11/2001 Wein
6,341,689 B1 1/2002 Jones
6,371,287 B1 4/2002 Jones et al.
6,398,078 B1 * 6/2002 Moran ..... A47G 23/0241 222/173
6,510,982 B2 * 1/2003 White ..... A47F 5/112 206/736
6,571,941 B2 6/2003 Holley, Jr.
6,695,137 B2 2/2004 Jones et al.
6,736,260 B2 5/2004 Gomes et al.
6,802,802 B2 10/2004 Woog
6,814,228 B2 11/2004 Sutherland
6,938,756 B2 9/2005 Schuster
7,011,209 B2 3/2006 Sutherland et al.
7,025,197 B2 4/2006 Sutherland
7,070,045 B2 7/2006 Theelen
7,128,206 B2 10/2006 Kohler
7,134,547 B2 11/2006 Auclair
7,207,934 B2 4/2007 Schuster
7,234,596 B2 6/2007 Lebras

(56) References Cited

U.S. PATENT DOCUMENTS

| | | | | |
|---|---|---|---|---|
| 7,374,038 | B2 | 5/2008 | Smalley | |
| 7,448,492 | B2 | 11/2008 | Sutherland | |
| 7,472,791 | B2 | 1/2009 | Spivey, Sr. | |
| 7,552,820 | B2 * | 6/2009 | Kohler | B65D 71/0018 206/199 |
| 7,604,116 | B2 * | 10/2009 | Schuster | B65D 71/0077 206/176 |
| 7,644,817 | B2 | 1/2010 | Sutherland | |
| 7,677,387 | B2 | 3/2010 | Brand et al. | |
| 7,753,196 | B2 * | 7/2010 | Cuomo | B65D 71/0014 206/162 |
| 7,762,395 | B2 | 7/2010 | Sutherland et al. | |
| 7,762,397 | B2 | 7/2010 | Coltri-Johnson et al. | |
| 7,793,780 | B2 | 9/2010 | Smalley | |
| 7,959,062 | B2 | 6/2011 | Auclair | |
| 8,020,695 | B2 | 9/2011 | Brand | |
| 8,297,437 | B2 | 10/2012 | Smalley et al. | |
| 8,622,207 | B2 | 1/2014 | Smalley | |
| 9,415,914 | B2 | 8/2016 | Holley, Jr. | |
| 2002/0077236 | A1 | 6/2002 | Chalendar et al. | |
| 2002/0117407 | A1 | 8/2002 | Holley | |
| 2003/0111363 | A1 | 6/2003 | Theelen | |
| 2003/0159950 | A1 | 8/2003 | Jones et al. | |
| 2003/0213705 | A1 | 11/2003 | Woog | |
| 2004/0026269 | A1 | 2/2004 | Cuomo | |
| 2004/0050722 | A1 | 3/2004 | Schuster | |
| 2004/0094435 | A1 | 5/2004 | Auclair et al. | |
| 2005/0167292 | A1 | 8/2005 | Sutherland | |
| 2005/0211577 | A1 | 9/2005 | Bakx | |
| 2005/0218014 | A1 | 10/2005 | Schuster | |
| 2005/0230273 | A1 | 10/2005 | Kohler | |
| 2006/0091024 | A1 | 5/2006 | Cuomo | |
| 2006/0148629 | A1 | 7/2006 | Cuomo | |
| 2006/0157545 | A1 | 7/2006 | Auclair | |
| 2006/0231440 | A1 | 10/2006 | Holley, Jr. | |
| 2007/0000980 | A1 | 1/2007 | Oliveira | |
| 2007/0017839 | A1 | 1/2007 | Sutherland | |
| 2007/0029212 | A1 | 2/2007 | Smalley | |
| 2007/0151873 | A1 | 7/2007 | Schuster | |
| 2007/0199859 | A1 | 8/2007 | Cook et al. | |
| 2008/0210581 | A1 | 9/2008 | Brand | |
| 2008/0265008 | A1 | 10/2008 | Holley | |
| 2009/0008273 | A1 | 1/2009 | Smalley | |
| 2010/0006458 | A1 | 1/2010 | Wilkins et al. | |
| 2010/0072086 | A1 | 3/2010 | Smalley | |
| 2011/0048975 | A1 | 3/2011 | Brand | |
| 2012/0000913 | A1 | 1/2012 | Smalley et al. | |
| 2014/0291386 | A1 | 10/2014 | Ikeda | |

FOREIGN PATENT DOCUMENTS

| | | |
|---|---|---|
| EP | 0 894 733 A1 | 2/1999 |
| EP | 1 319 607 | 6/2003 |
| EP | 1 852 359 | 11/2007 |
| EP | 2 102 073 | 9/2010 |
| FR | 2 825 074 | 11/2002 |
| GB | 926874 | 5/1963 |
| WO | WO 97/05026 | 2/1997 |
| WO | WO 99/01356 | 1/1999 |
| WO | WO 2006/020525 | 2/2006 |
| WO | WO 2008/089124 | 7/2008 |

* cited by examiner

CARRIER FOR CONTAINERS

CROSS-REFERENCE TO RELATED APPLICATION

This application claims the benefit of U.S. Provisional Patent Application No. 62/543,053, filed on Aug. 9, 2017.

INCORPORATION BY REFERENCE

The disclosure of U.S. Provisional Patent Application No. 62/543,053, filed on Aug. 9, 2017, is hereby incorporated by reference for all purposes as if presented herein in its entirety.

BACKGROUND OF THE DISCLOSURE

The present disclosure generally relates to carriers or cartons for holding and displaying containers. More specifically, the present disclosure relates to carriers that can be inserted into an outer carton.

SUMMARY OF THE DISCLOSURE

According to one aspect of the disclosure, a carrier for holding at least one container comprises a plurality of panels extending at least partially around an interior of the carrier, the plurality of panels comprising a front panel, a back panel, at least one central panel, at least one side panel, and at least one bottom panel. The carrier further comprises at least one divider flap foldably connected to one of the front panel and the back panel, the at least one divider flap folded away from the one of the front panel and the back panel to form at least one opening in the one of the front panel and the back panel, the at least one divider flap extends through the interior of the carrier to the at least one central panel.

According to another aspect of the disclosure, a blank for forming a carrier for holding at least one container comprises a plurality of panels for extending at least partially around an interior of the carrier formed from the blank, the plurality of panels comprising a front panel, a back panel, at least one central panel, at least one side panel, and at least one bottom panel. The blank further comprises at least one divider flap foldably connected to one of the front panel and the back panel, the at least one divider flap is for being folded away from the one of the front panel and the back panel to form at least one opening in the one of the front panel and the back panel in the carrier formed from the blank, the at least one divider flap extends through the interior of the carrier formed from the blank to the at least one central panel.

According to another aspect of the disclosure, a method of forming a carrier for holding at least one container comprises obtaining a blank comprising a plurality of panels, the plurality of panels comprising a front panel, a back panel, at least one central panel, at least one side panel, and at least one bottom panel, the blank further comprising at least one divider flap foldably connected to one of the front panel and the back panel. The method further comprises folding the plurality of panels at least partially around an interior of the blank, and the method further comprises folding the at least one divider flap away from the one of the front panel and the back panel to form at least one opening in the one of the front panel and the back panel and such that the at least one divider flap extends through the interior of the carrier to the at least one central panel.

According to another aspect of the disclosure, a system comprises a first carrier and a second carrier. The first carrier comprises a plurality of panels extending at least partially around an interior of the first carrier, the plurality of panels comprising a front panel, a back panel, at least one central panel, at least one side panel, and at least one bottom panel. The first carrier further comprises at least one divider flap foldably connected to one of the front panel and the back panel, the at least one divider flap folded away from the one of the front panel and the back panel to form at least one opening in the one of the front panel and the back panel, the at least one divider flap extends through the interior of the first carrier to the at least one central panel. The second carrier comprises a plurality of panels extending at least partially around an interior of the second carrier, at least one panel of the plurality of panels of the second carrier is positioned adjacent the one of the front panel and the back panel of the first carrier to cover the at least one opening of the first carrier.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, glass; plastics such as PET, LDPE, LLDPE, HDPE, PP, PS, PVC, EVOH, and Nylon; and the like; aluminum and/or other metals; or any combination thereof.

Carriers according to the present disclosure can accommodate containers of numerous different shapes. For the purpose of illustration and not for the purpose of limiting the scope of the disclosure, the following detailed description describes beverage containers (e.g., glass bottles) at least partially disposed within the carrier embodiments. In this specification, the terms "lower," "bottom," "upper," "top," "front," and "back" indicate orientations determined in relation to fully erected carriers.

As described herein, carriers may be formed by multiple overlapping panels, end flaps, and/or other portions of blanks. Such panels, end flaps, and/or other portions of the blank can be designated in relative terms to one another, e.g., "first", "second", "third", etc., in sequential or non-sequential reference, without departing from the disclosure.

Figure 1:
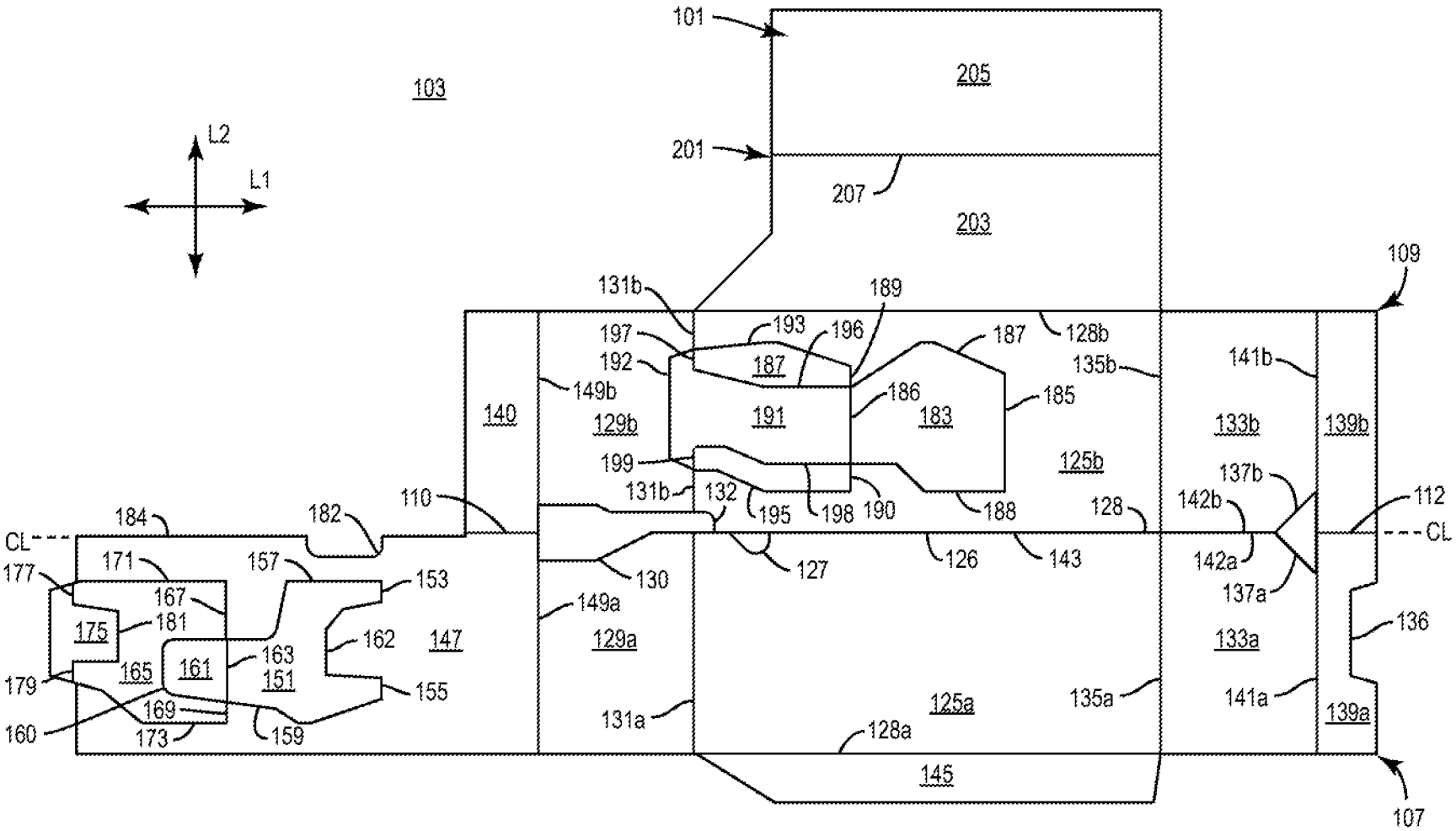
FIG. 1 is a plan view of an outer surface of a blank for forming a carrier according to an exemplary embodiment of the disclosure.
Figure 2:
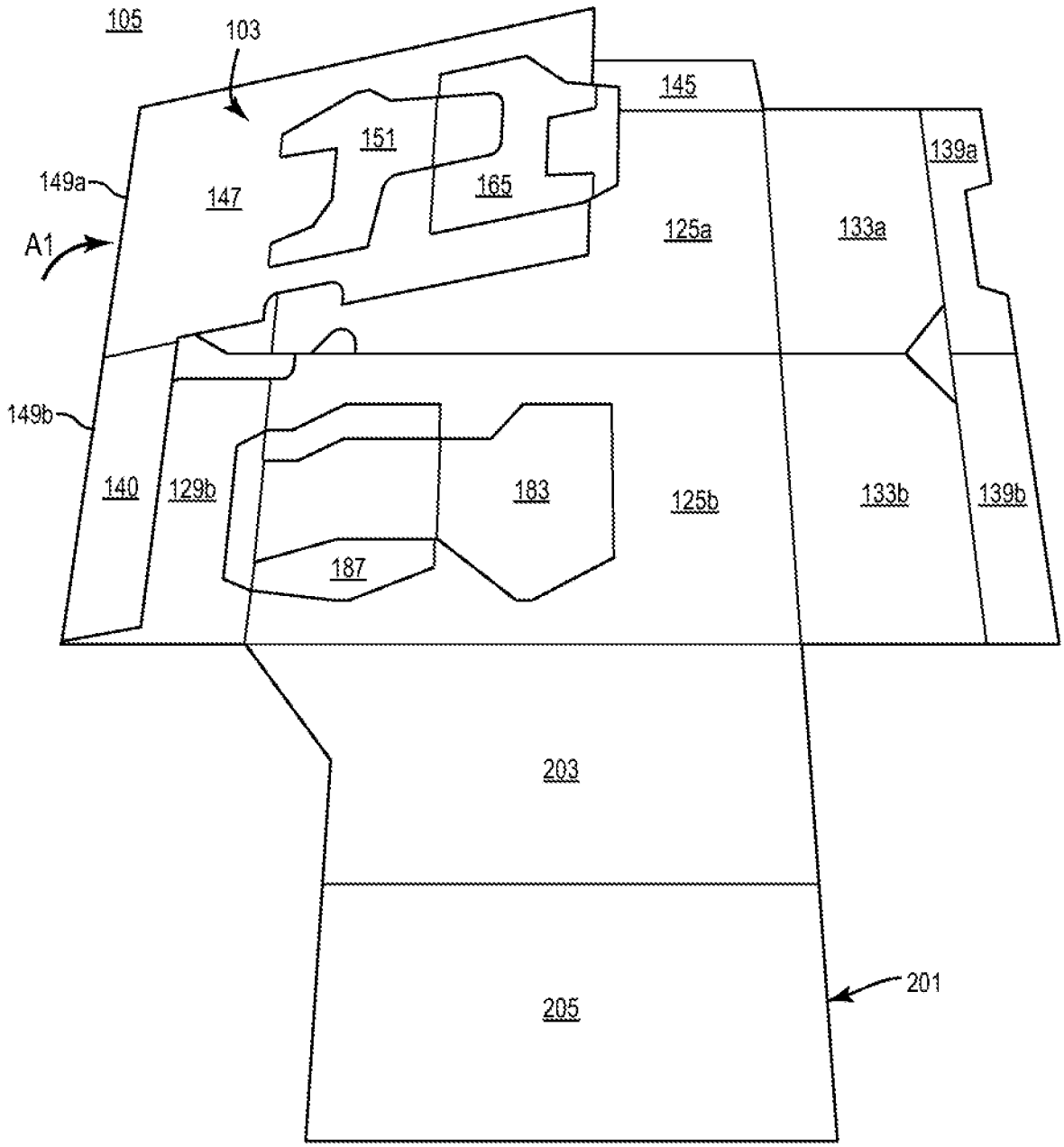
FIG. 2 is a first sequential perspective view of a partial folding of the blank of FIG. 1 according to an exemplary embodiment of the disclosure.
Figure 3:
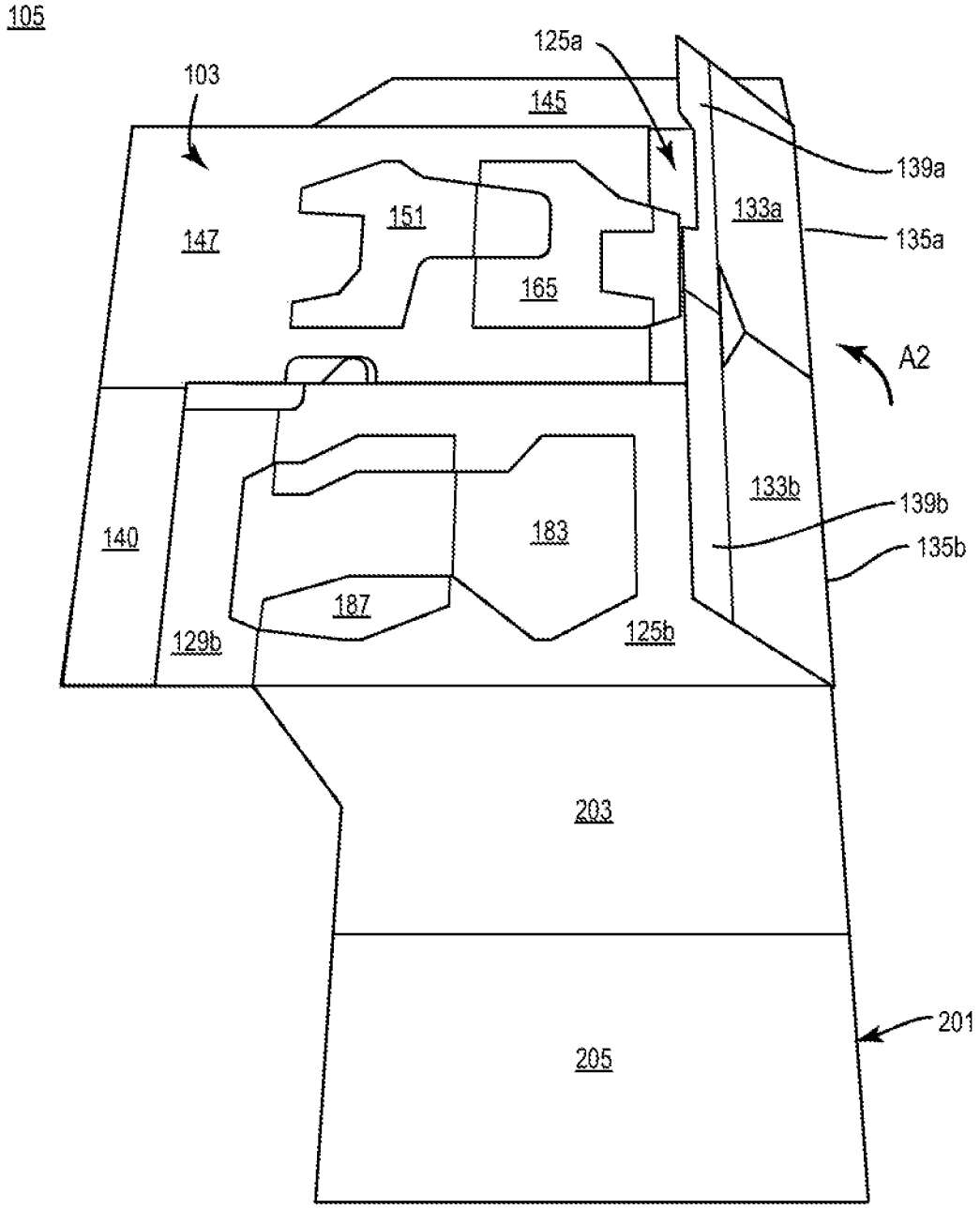
FIG. 3 is a second sequential perspective view of a partial folding of the blank of FIG. 1 according to an exemplary embodiment of the disclosure.
Figure 4:
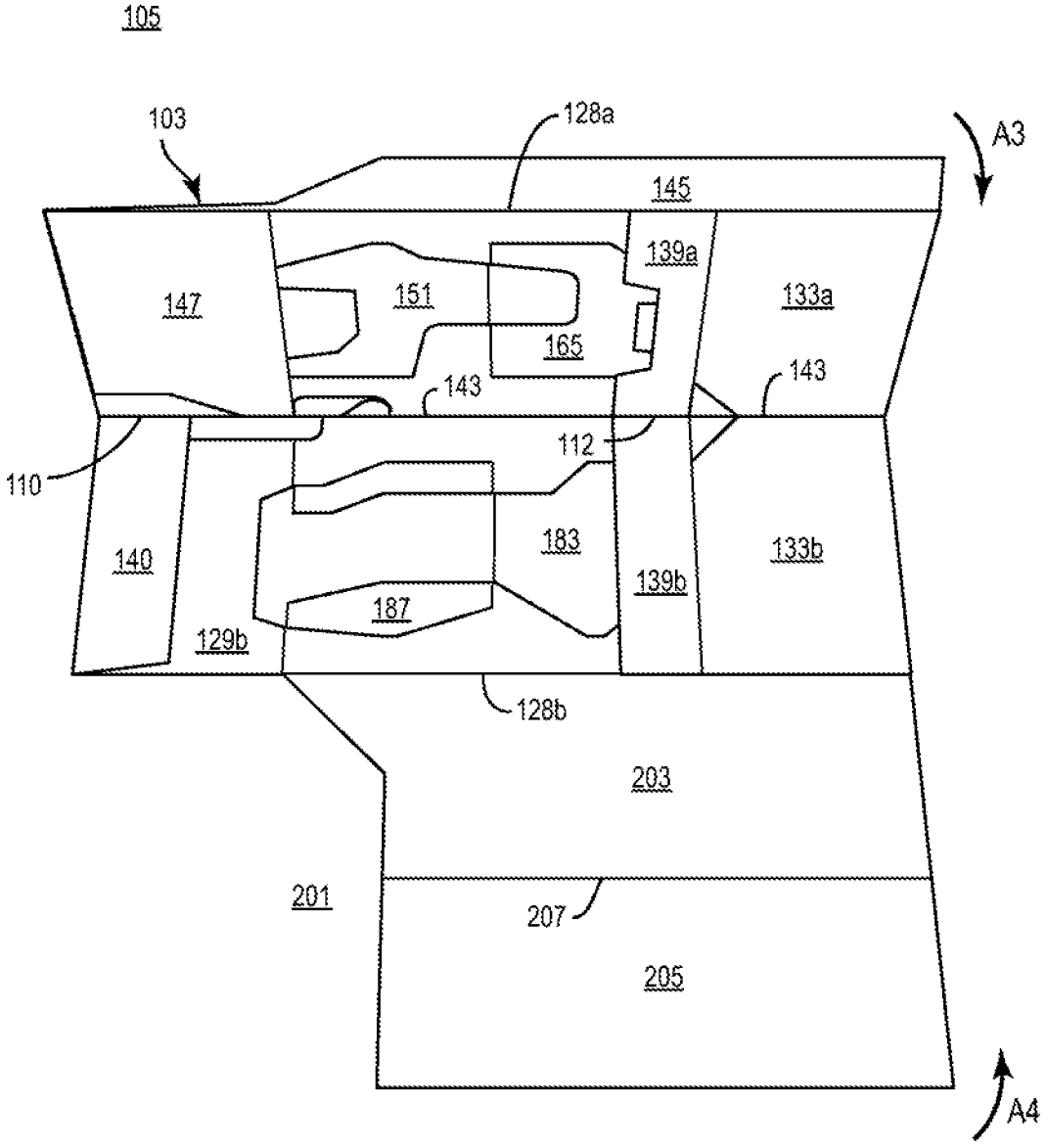
FIG. 4 is a third sequential perspective view of a partial folding of the blank of FIG. 1 according to an exemplary embodiment of the disclosure.
Figure 5:
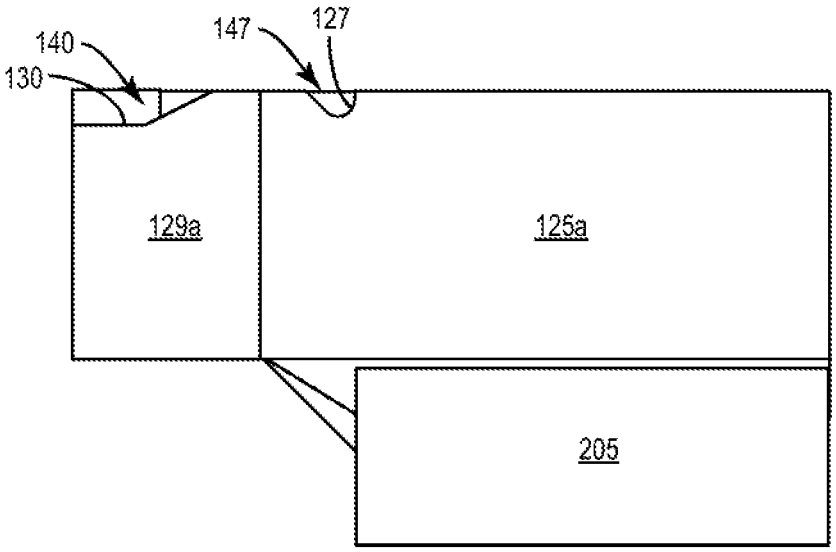
FIG. 5 is a plan view of a carton formed from the blank of FIG. 1 in a folded configuration according to an exemplary embodiment of the disclosure.
Figure 10:
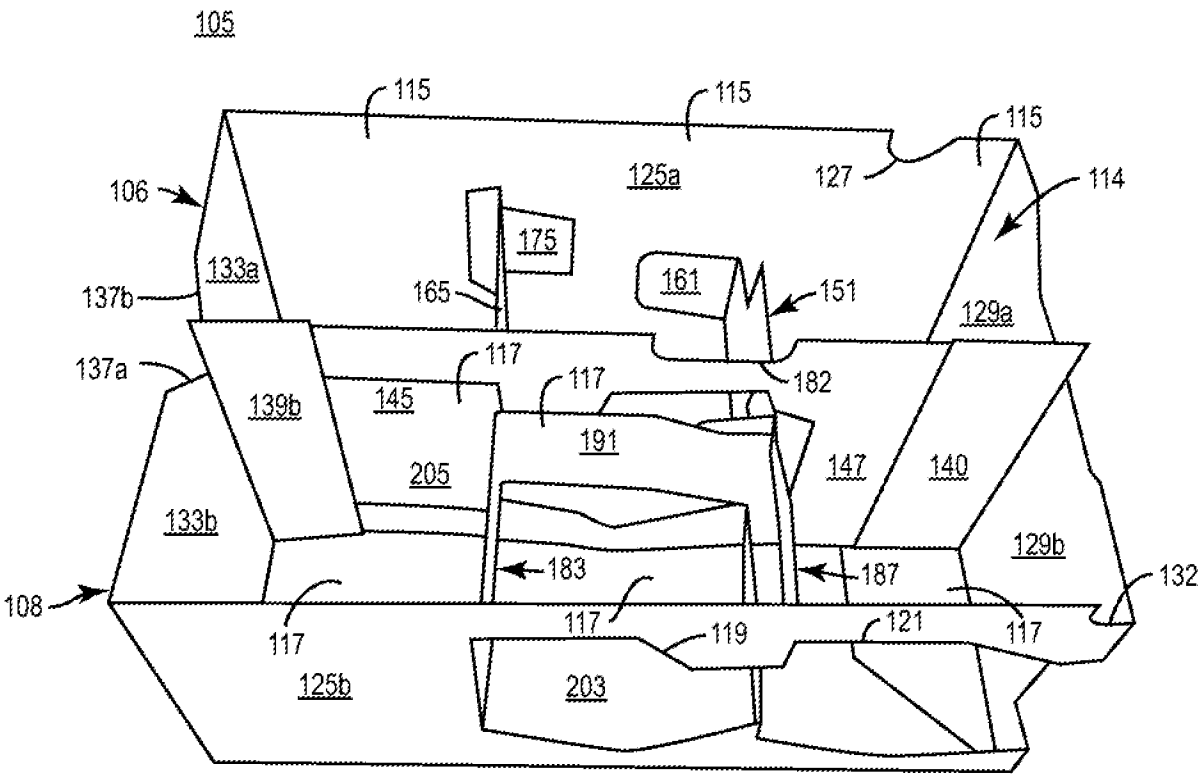
FIG. 10 is a perspective view of the carton of FIGS. 5 and 6 in an erected configuration.

FIG. 1 shows a plan view of an exterior side 101 of a blank 103 used to form a package or carrier 105 (FIG. 10) in accordance with a first exemplary embodiment of the disclosure. As shown in FIG. 10, the carrier 105 is sized to contain six containers C, three containers C being contained in a front portion 106 of the carrier 105 and three containers C being contained in a back portion 108 of the carrier 105. In the illustrated embodiment, the containers C can be beverage bottles, but the containers C could be any other suitable type and size of container without departing from the disclosure. The carrier 105 can be sized and shaped to hold more or less than six containers C. In one embodiment, the front portion 106 and the back portion 108 of the carrier 105 each have three containers C. In other embodiments, the front portion 106 and the back portion 108 of the carrier 105 can hold more or less than three containers C without departing from the disclosure.

As shown in FIG. 1, the blank 103 has a longitudinal axis L1 and a lateral axis L2. The blank 103 has a front portion 107 for forming the front portion 106 of the carrier 105 (FIG. 10), and a back portion 109 for forming the back portion 108 of the carrier 105 (FIG. 10). In one embodiment, the front portion 107 and the back portion 109 are separated at a longitudinal centerline CL of the blank 103, as shown. As discussed in more detail below, the blank 103 is formed into the carrier 105 by folding the blank 103 about fold lines 110, 112 along the centerline CL so that the front portion 107 and the back portion 109 of the blank 103 are overlapped in at least partial face-to-face contact.

In the illustrated embodiment, the front portion 107 of the blank 103 comprises a front panel 125*a* having a notch 127 (broadly, "first notch") at an upper edge 126 of the front panel 125*a* defined by a cut 143 and that extends downwardly from an upper edge thereof and a first side panel 129*a* (broadly, "first front side panel") foldably connected to the front panel 125*a* at a lateral fold line 131*a*. As shown, an upper portion of the first side panel 129*a* defines a notch or downwardly-extending edge 130 of the first side panel 129*a* that can include one or more angled and/or curved portions. A second side panel 133*a* (broadly, "second front side panel"), as shown, is foldably connected to the front panel 125*a* at a lateral fold line 135*a*, and includes a notch or chamfer 137*a* at the upper edge 142*a* thereof. While the chamfer 137*a* is illustrated as linear, it will be understood that the chamfer 137*a* can be angled or curved without departing from the disclosure. A keel 139*a*, as shown, is foldably connected to the second side panel 133*a* at a lateral fold line 141*a* that is interrupted by the chamfer 137*a* of the second side panel 133*a*. The keel 139*a* can include a notched or recessed portion 136 along a free edge thereof. As shown, the front panel 125*a* and the first side panel 129*a* are separated from the back portion 109 of the blank 103 along the longitudinally-extending cut 143. As also shown, the notch 127 of the front panel 125*a* can be a recessed portion of the front panel 125*a* that is disposed between portions of the cut 143. The front portion 107 of the blank 103, as shown in FIG. 1, also includes a front bottom flap 145 foldably connected to the front panel 125*a* at a lateral fold line 128*a*.

As shown in FIG. 1, the front portion 107 of the blank 103 also includes a central panel 147 foldably connected to the first side panel 129*a* at a lateral fold line 149*a*. The illustrated central panel 147 includes a first divider flap 151 (broadly, "third divider flap" or "fourth divider flap") that is foldably connected to the central panel 147 at lateral fold lines 153, 155 and which is at least partially separable from the central panel 147 at lines of weakening 157, 159 that each may include one or more curved and/or angled portions and which extend from the respective fold lines 153, 155 to intersect a generally lateral line of weakening 160 that extends from the line of weakening 157 to the line of weakening 159. A line of weakening 162 also extends from the fold line 153 to the fold line 155 to facilitate at least partial separation of the divider flap 151 from the central panel 147, and can include one or more curved or angled portions. An attachment flap 161, as shown, is foldably connected to the first divider flap 151*a* at a lateral fold line 163 and is separable from the remainder of the central panel 147 at one or more portions of one or more of the lines of weakening 157, 159, 160. The central panel 147, as shown, also includes a second divider flap 165 (broadly, "third divider flap" or "fourth divider flap") that is foldably connected to the central panel 147 at lateral fold lines 167, 169 and which is at least partially separable from the central panel 147*a* at lines of weakening 171, 173 that extend from the respective fold lines 167, 169 to a free edge of the central panel 147, each of which may include one or more curved and/or angled portions. The divider flap 165 is also at least partially separable from the attachment flap 161 along a portion of one or more of the lines of weakening 157, 159, 160. An attachment flap 175, as shown, is foldably connected to a marginal portion of the second divider flap 165 at lateral fold lines 177, 179 and is separable from a portion of the second divider flap 165 along a line of weakening 181 that extends from the fold line 177 to the fold line 179 and can include one or more curved and/or angled portions. The attachment flap 175 can protrude past the free edge of the central panel 147, as shown, or can have a different configuration without departing from the disclosure. As shown, the central panel 147 also includes a notch 182 (broadly, "third notch") at an upper edge 184 thereof. As described herein, the notch 182 of the central panel 147 cooperates with the notch 127 of the front panel 125*a* during folding operations of the blank 103. The central panel 147 could be otherwise shaped, arranged, and/or configured, and could have other features, without departing from the disclosure.

In the illustrated embodiment, the back portion 109 of the blank 103 includes a back panel 125*b*, a first side panel 129*b* (broadly "first back side panel"), a second side panel 133*b* (broadly, "second back side panel"), and a keel 139*b* having associated features that are generally a mirror-image of the corresponding panels and flaps of the front portion 107 of the blank 103. Corresponding components (e.g., panels, flaps, fold lines, cuts, etc.) have been designated by corresponding reference numbers that differ by the "a" or "b" suffix, with the "a" components corresponding to the front portion 107 of the blank 103 and the "b" components corresponding to the back portion 109 of the blank 103. The keel 139*b*, as shown, can be devoid of the recessed portion 136 of the keel 139*a*, or can have a different configuration without departing from the disclosure.

As shown in FIG. 1, and in contrast to the front portion 107, the back portion 109 of the blank 103 includes a second keel 140 foldably connected to the second side panel 133*b* at the fold line 149*b* that is at least partially coextensive with the central panel 147 such that the keel 139*b* is a first keel of the back portion 109 of the blank 103. The back portion 109 of the blank 103, as shown, also defines a notch 132 (broadly, "second notch") at an upper edge 128 of the back panel 125*b* which extends into and at least partially defines an upper edge of the side panel 129*b*. Further, the back panel 125*b* includes a first divider flap 183 (broadly, "first divider flap" or "second divider flap") that is foldably connected to the back panel 125*b* at a lateral fold line 185 and which is separable from the back panel 125*b* at lines of weakening 187, 188 that each extend from the fold line 185 to lateral fold lines 189, 190. Either or both of the lines of weakening 187, 188 can have one or more curved and/or angled portions. An attachment flap 191 is foldably connected to the first divider flap 183 at a lateral fold line 186 that extends from the line of weakening 187 to the line of weakening 188, as shown, and extends into a portion of the first side panel 129*b*. A second divider flap 187 (broadly, "first divider flap" or "second divider flap"), as shown, is foldably connected to the back panel 125*b* at lateral fold lines 189, 190 that intersect the fold line 186, and is separable from the back panel 125*b* at lines of weakening 193, 195 each of which may have one or more curved and/or angled portions, that interrupt the fold line 131*b* and extend from the respective fold lines 189, 190 into a portion of the first side panel 129*b*. The attachment flap 191 is foldably connected to the second side panel 133*b* at lateral fold lines 197, 199 that intersect respective portions of the fold line 131*b*, and is at least partially separable from the divider flap 187 at generally longitudinally-extending lines of weakening 196, 198 that extend from the respective fold lines 189, 190 to respective portions of the fold line 131*b*. The attachment flap 191 is also at least partially separable from the side panel 129*b* at portions of the lines of weakening 193, 195 and at a lateral line of weakening 192 that extends from the line of weakening 193 to the line of weakening 195. In this regard, the attachment flap 191 interconnects the first divider flap 183 and the second divider flap 187. As also shown, the back portion 109 of the blank 103 includes a bottom panel 201 foldably connected to the back panel 125*b* at the fold line 128*b* and which includes a proximal portion 203 and a distal portion 205 foldably connected to the proximal portion 203 at a longitudinal fold line 207.

Any of the panels, flaps, fold lines, cuts, or other features could be otherwise shaped, arranged, and/or omitted from the blank 103 without departing from the disclosure. In one embodiment, an additional central panel for positioning in at least partial face-to-face contact with the central panel 147 could be provided on the blank 103. The blank 103 could be sized and/or shaped to accommodate more or less than six containers without departing from this disclosure.

Still referring to FIG. 1, and referring additionally to FIGS. 2-6, assembly of the blank 103 into the carrier 105 (FIG. 10) is illustrated according to one exemplary embodiment of the disclosure. As shown, the carrier 105 can be erected from the blank 103 by folding the central panel 147 and the second keel 140 at the respective fold lines 149*a*, 149*b* in the direction of the arrow A1 such that the central panel 147 is in at least partial face-to-face contact with the first side panel 129*a* and the front panel 125*a* and such that the second keel 140 is in at least partial face-to-face contact with the first side panel 129*b*.

The second side panels 133*a*, 133*b* can then be folded at the respective fold lines 135*a*, 135*b* in the direction of the arrow A2 such that the second side panel 133*a* is in at least partial face-to-face contact with a portion of the front panel 125*a* and a portion of the central panel 147, the keel 139*a* is in at least partial face-to-face contact with the central panel 147, the second side panel 133*b* is in at least partial face-to-face contact with the back panel 125*b*, and the keel 139*b* is in at least partial face-to-face contact with the back panel 125*b*.

The central panel 147 can then be folded at the fold line 110 and the keel 139*a* can then be folded at the fold line 112 in the direction of the arrow A3 such that the central panel 147 is in at least partial face-to-face contact with the second keel 140 and a portion of the back panel 125*b*, the second side panel 133*a* is in at least partial face-to-face contact with the second side panel 133*b*, and the keel 139*a* is in at least partial face-to-face contact with the keel 139*b*. In such a configuration, the attachment flaps 161, 175 of the respective first and second divider flaps 151, 165 can be secured in at least partial face-to-face contact with the front panel 125*a* and the attachment flap 191 of the first and second divider flaps 183, 187 can be secured in at least partial face-to-face contact with portions of the central panel 147. The attachment flaps 161, 185, 191 can be secured in the above-described positions with an adhesive such as glue. The distal portion 205 of the bottom panel 201 can also be folded at the fold line 207 in the direction of the arrow A4 into at least partial face-to-face contact with the bottom flap 145. As described above, any of the panels and/or flaps of the blank 103 may be treated, for example, with an adhesive such as glue, to facilitate securing and contact of panels and/or flaps to one another in the course of forming the carrier 105. Folding of the blank 103 into the carrier 105 can be performed with different and/or differently-ordered steps without departing from the disclosure.

Figure 6:
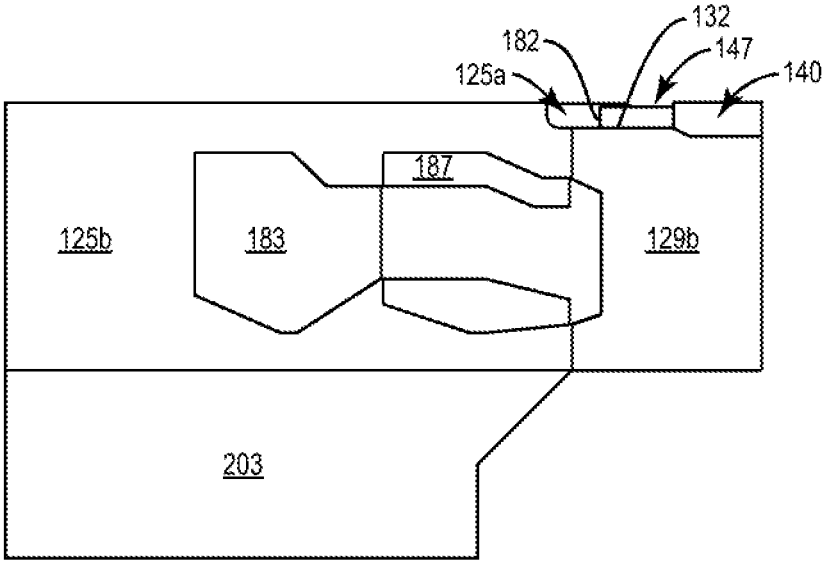
FIG. 6 is a plan view of the carton in the folded configuration of FIG. 5 and viewed from an opposite side.
Figure 7:
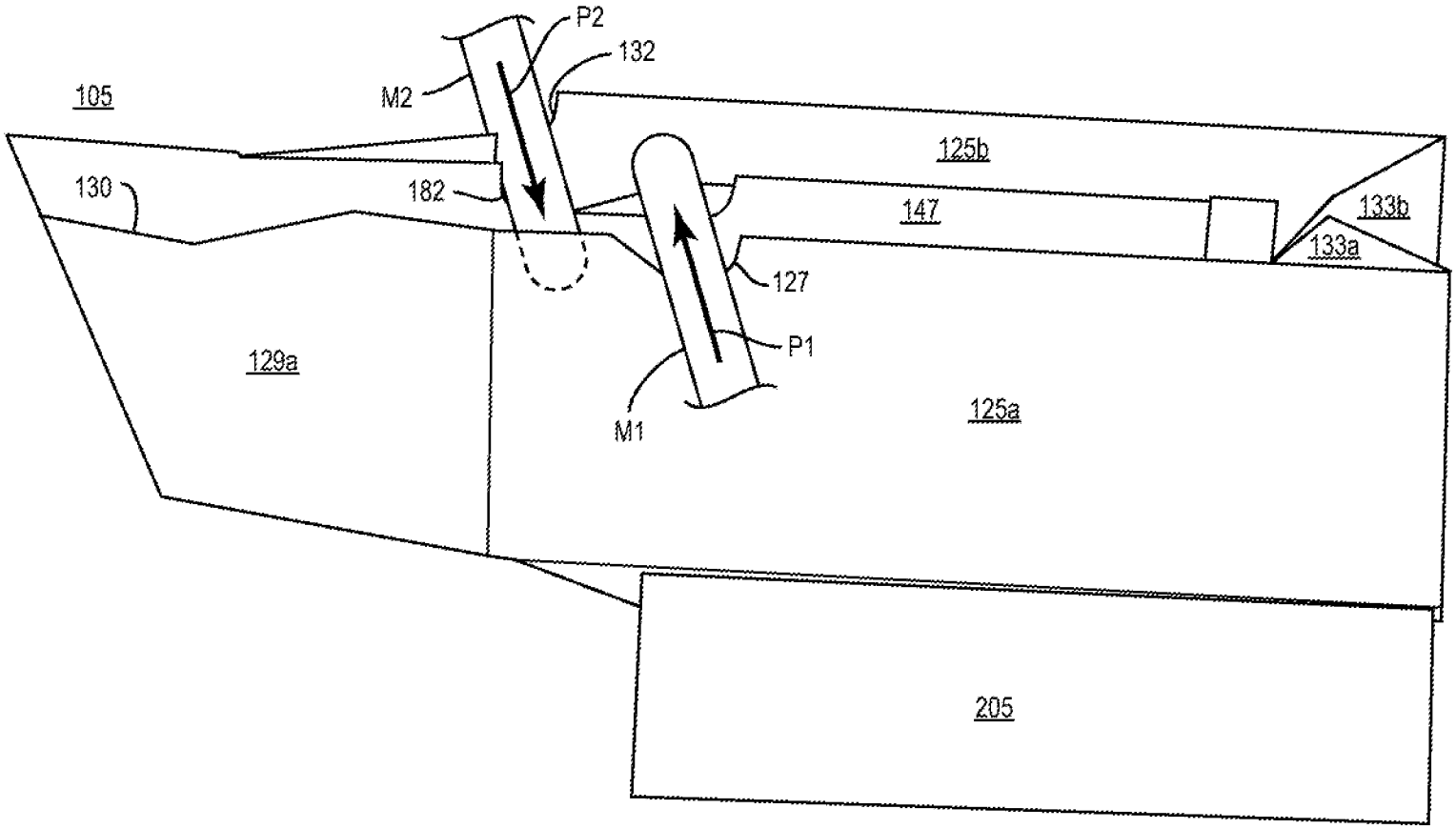
FIG. 7 is a perspective view of a partial movement of the carton in the folded configuration of FIGS. 5 and 6 toward an erected configuration.
Figure 8:
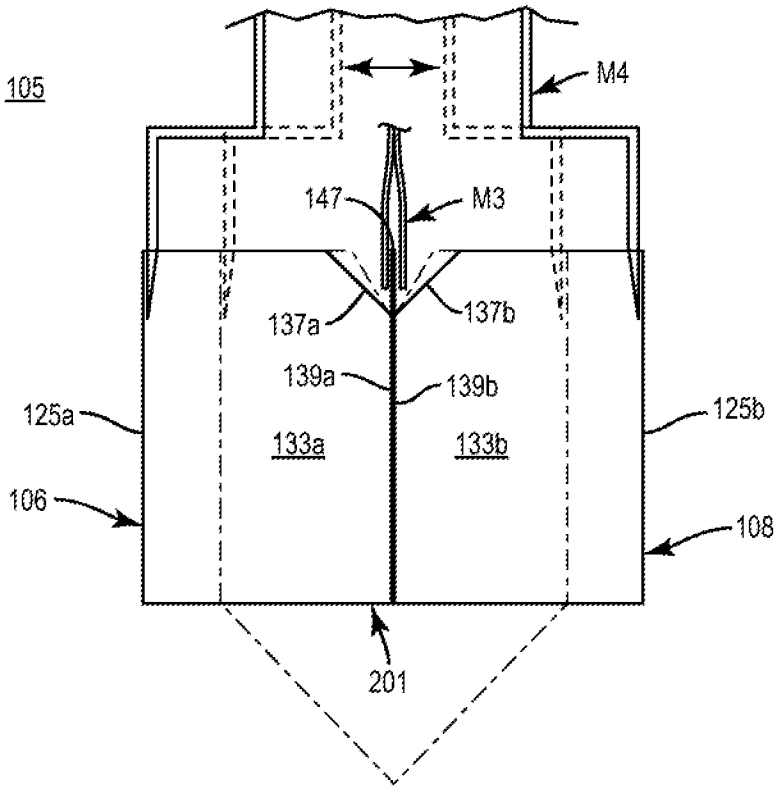
FIG. 8 is a schematic side view of the carton of FIG. 7 being partially moved further toward an erected configuration of the carton.

Referring to FIGS. 6-8, the folded configuration of the carrier 105 formed from the blank 103 as described above is illustrated. In the folded configuration of the carrier 105 shown, the notch 127 of the front panel 125*a* and the notch 182 of the central panel 147 are aligned, e.g., in at least partial overlapping relation along the longitudinal axis L1 (FIG. 1), such that the notch 127 provides an access path P1 (broadly, "first access path") from the front panel 125*a* to a portion of the central panel 147 that is aligned with the notch 127, e.g., the notch 182. Accordingly, in the folded configuration of the carrier 105, the access path P1 provides access through the notch 127, past the central panel 147 through the notch 182, and to a portion of the back panel 125*b* that is aligned with the notches 127, 182. In this regard, in the folded configuration shown, the notches 127, 182 provide the access path P1 for a machine component M1, for example, an actuator, finger, rod, pusher, and/or suction device, to name a few, to contact the back panel 125*b* and urge the back panel 125*b* away from the front panel 125*a* and the central panel 147 in the course of forming the carrier 105. Similarly, the notch 132 of the back panel 129*b* is aligned with a portion of the central panel 147, e.g., the notch 182. Accordingly, in the folded configuration of the carrier 105, the notch 132 of the back panel 125*b* and the notch 182 of the central panel 147 are aligned such that the notches 132, 182 provide an access path P2 (broadly, "second access path") from the back panel 125*b*, past the central panel 147 through the notch 182, and to a portion of the front panel 125*a* that is aligned with the notches 132, 182 such that a machine component M2, which can be substantially similar to machine component M1, can contact the front panel 125*b* through the notches 132, 182 and urge the front panel 125*a* away from the back panel 125*b* and the central panel 147 in the course of forming the carrier 105. In one embodiment, a manual operator can effect relative movement of one or more portions of the carrier 105 via the access paths P1, P2. In one embodiment, either of the machine components M1, M2 can be passed through either of the access paths P1, P2 described herein. It will be understood that the actions of the machine components M1, M2 can be performed in any sequence, or in tandem, without departing from the disclosure.

Figure 13:
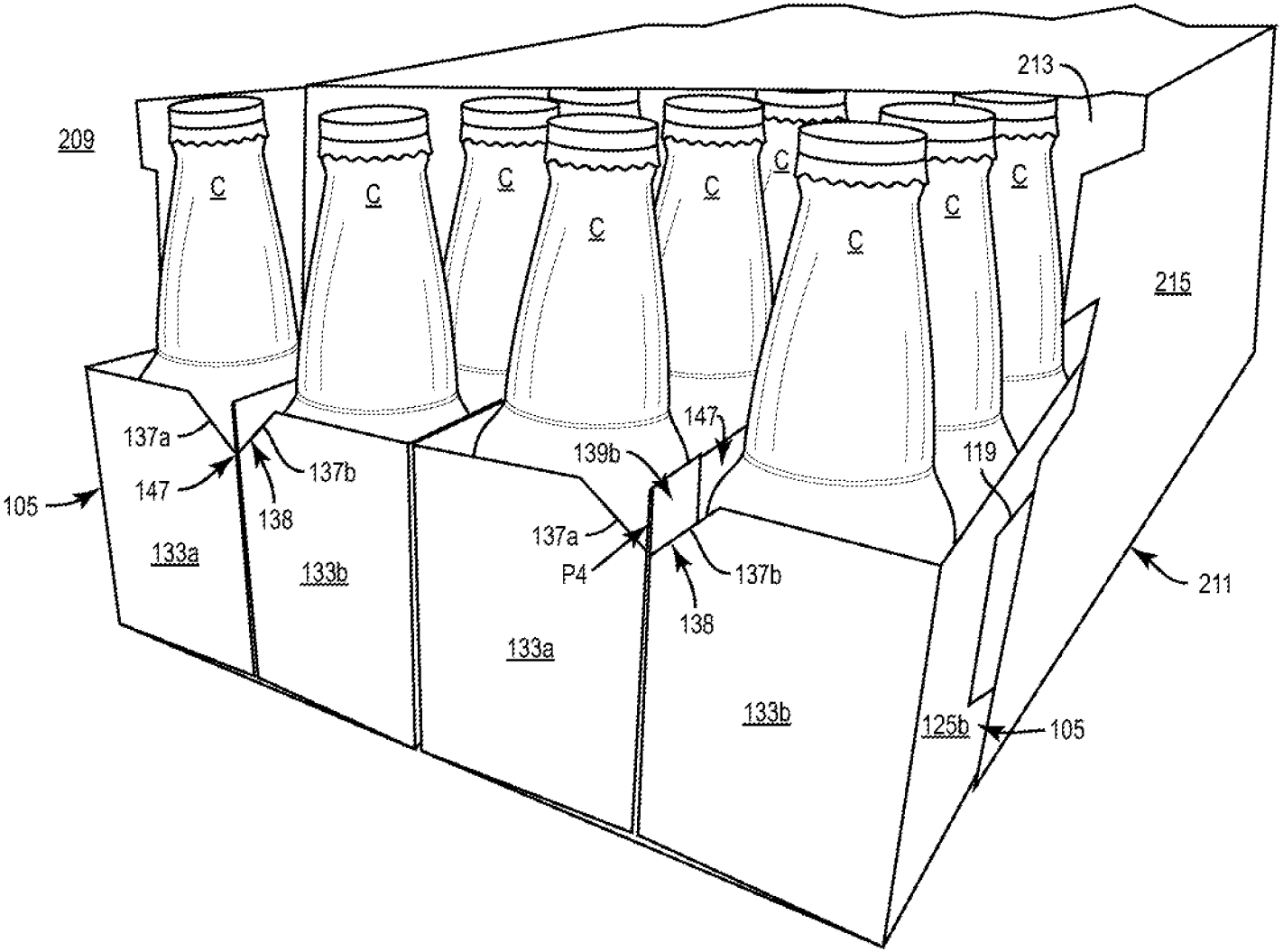
FIG. 13 is a perspective view of the system of FIG. 12 being loaded into an outer container.

Referring additionally to FIG. 8, prior to, during, and/or following the urging of the back panel 125*b* through the notches 127, 182 and/or the urging of the front panel 125*a* through the notches 132, 182 as described above, one or more portions of the central panel 147 of the folded configuration of the carrier 105 can be grasped by a guide M3, which can be a machine component such as a clamp, grasper, pincer, and/or suction device, to name a few. In one embodiment, the guide M3 can engage portions of the central panel 147 and/or a portion of the keels 139*a*, 139*b* from above the carrier 105. In another embodiment, the guide M3 can laterally engage portions of the central panel 147 and/or a portion of the keels 139*a*, 139*b*, 140 through recessed portions of the front and/or back panels 125*a*, 125*b* at which the central panel 147 is exposed, for example, the notches 127 and/or 132. The guide M3 can also engage portions of the central panel 147 and/or a portion of the keels 139*a*, 139*b*, 140 at portions thereof exposed above or through the panels 125*a*, 125*b*, 129*a*, 129*b*, 133*a*, 133*b*. For example, as the folded configuration of the carrier 105 is formed into the erected configuration of the carrier 105, each of the chamfers 137*a*, 137*b* of the respective second side panels 133*a*, 133*b* are adjacent the central panel 147 and the keels 139*a*, 139*b* such that each of the chamfers 137*a*, 137*b*, at least partially form a notch or recess 138 above or through which the central panel 147 and/or a portion of the keels 139*a*, 139*b* are exposed such that they can be grasped by the guide M3 or another machine component through an access path P4 (broadly, "fourth access path") (FIG. 13). As also shown, a machine component M4 can then be inserted between the central panel 147 and/or a portion of the keels 139*a*, 139*b*, 140 and one or both of the front panel 125*a* and the back panel 125*b* and moved outwardly to further space apart the front panel 125*a*, the central panel 125*b*, and the back panel 125*b* and transition the folded configuration of the carrier 105 into the erected configuration of the carrier 105. The machine component M4, as shown, can be a forked device or pair of arms actuatable to move the front and/or back panels 125*a*, 125*b* away from one another. The machine component M4 can have a different configuration without departing from the disclosure.

Figure 9:
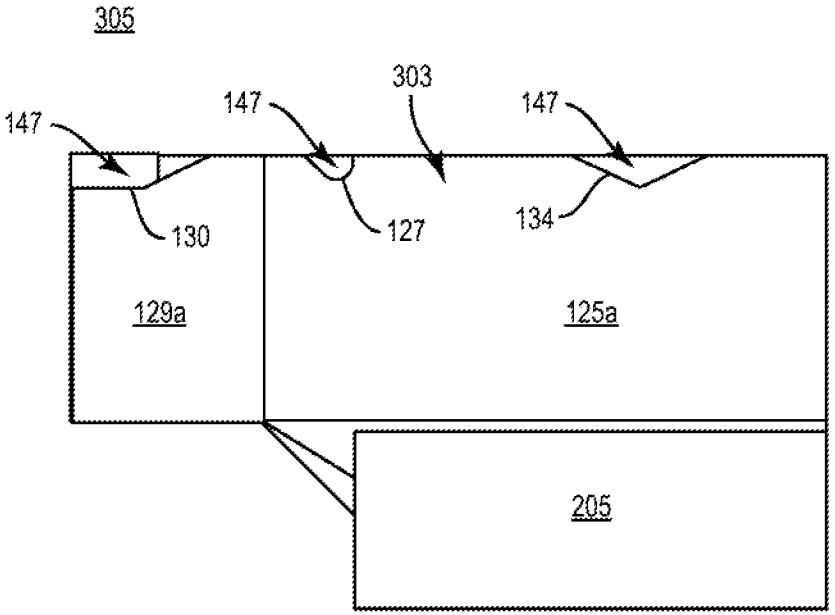
FIG. 9 is a plan view of the carton in the folded configuration of FIG. 5 according to an alternative exemplary embodiment of the disclosure.

Referring momentarily to FIG. 9, a blank according to an alternative embodiment of the disclosure is generally designated 303 and shown in a folded configuration of a carrier 305 similar to that of the blank 103 (FIG. 1) and the carrier 105 described above. The blank 303/carrier 305 is substantially similar to the blank 103/carrier 105 described above, but includes an additional notch 134 (broadly, "fourth notch") at the upper edge 126 of the front panel 125*a* that provides an access path P3 (broadly, "third access path") to a portion of the central panel 147 through which the central panel 147 can be grasped by a guide such as M3 (FIG. 8) during formation of the carrier 305. In one embodiment, one or both of the machine components M1, M2 can follow the access path P3 to engage a portion of the central panel 147. Blanks and carriers can include additional or alternative notches along portions thereof to facilitate folding and forming of a carrier without departing from the disclosure.

Figure 11:
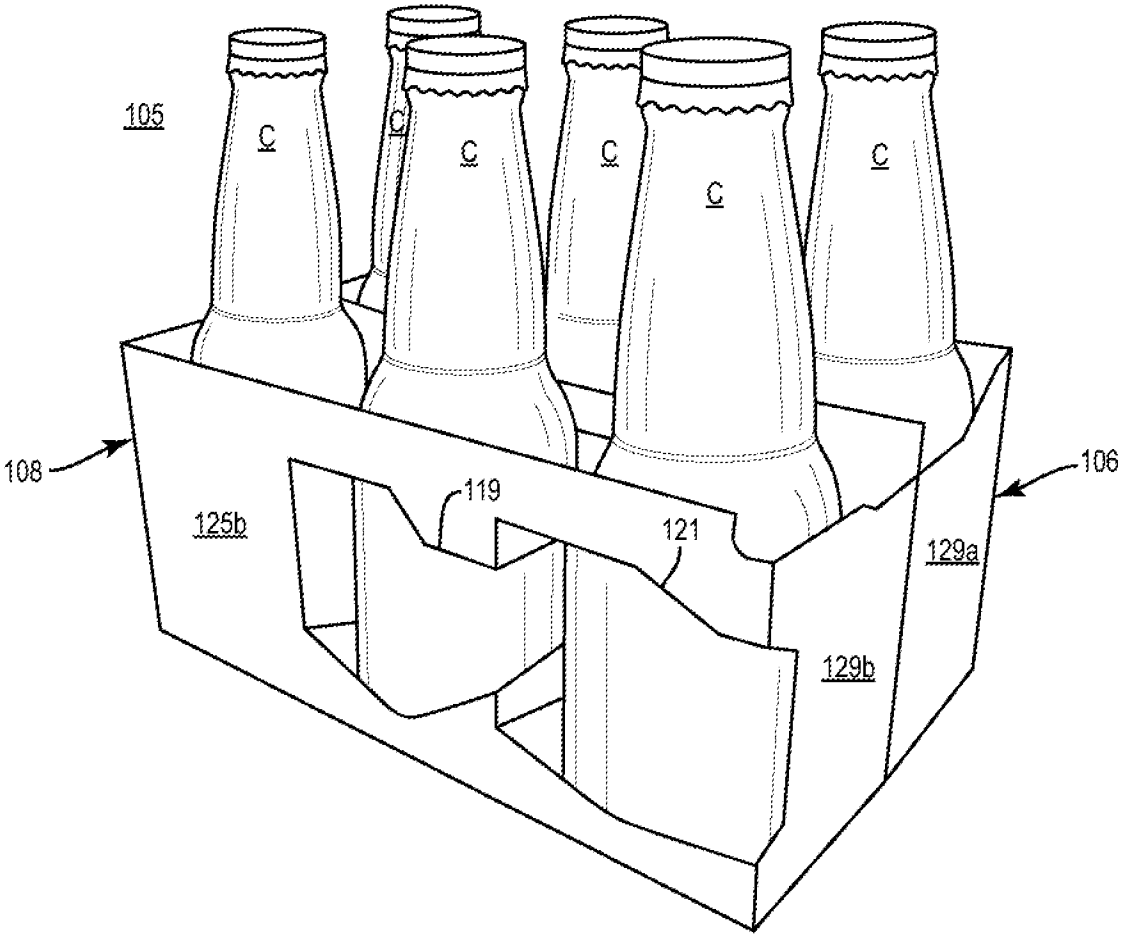
FIG. 11 is a perspective view of the carton of FIG. 10 loaded with a plurality of containers.

Referring again to FIG. 1, and turning to FIGS. 10 and 11, the erected configuration of the carrier 105 is thus formed by arranging the front panel 125*a*, the central panel 147, and the back panel 125*b* in parallel spaced relation, with the first side panel 129*a* and the second side panel 133*a* extending from the front panel 125*a* to the central panel 147 and the first side panel 129*b* and the second side panel 133*b* extending from the back panel 125*b* to the central panel 147, such that an interior 114 of the carrier 105 is defined. Formation of the carrier 105 in such an arrangement also results in at least partial separation of the first divider flap 151 from the central panel 147 and the second divider flap 165 at the lines of weakening 157, 159, 160, 162 and at least partial separation of the second divider flap 165 from the central panel 147 and the first divider flap 151 at the lines of weakening 171, 173, 157, 159, 160. The attachment flap 161 is at least partially separated from the second divider panel 165 at portions of the lines of weakening 157, 159, 160, the attachment flap 175 is at least partially separated from the second divider flap 165 at the line of weakening 181, and the attachment flaps 161, 175 are folded at the respective fold lines 163 and 177, 179 to be positioned in at least partial face-to-face contact with the front panel 125*a*.

Upon the aforementioned formation of the carrier 105, the first divider flap 183 is at least partially separated from the back panel 125*b* and the second divider flap 187 at the lines of weakening 178, 188, 196, 198 and the second divider flap 187 is at least partially separated from the back panel 125*b*, the first divider flap 183, and the side panel 129*b* at the lines of weakening 193, 195, 192. The attachment flap 191 is separated from the second divider flap 187 at the lines of weakening 196, 198 and the line of weakening 192, and the attachment flap 191 is folded at the fold lines 186, 197, 199 to be positioned in at least partial face-to-face contact with the central panel 147. In this regard, the divider flaps 151, 165 extend from the central panel 147 to the front panel 125*a* via the interior 114 of the carrier 105 and are attached to the front panel 125*a* with the attachment flaps 161, 175, and the divider flaps 183, 187 extend from the back panel 125*b* to the central panel 147 through the interior 114 of the carrier 105 and are attached to the central panel 147 via the attachment flap 191. In such an arrangement, three container-receiving spaces 115 are defined in the interior 114 of the carrier 105 in the front portion 106 of the carrier 105 and three container-receiving spaces 117 are defined in the interior 114 of the carrier 105 in the back portion 108 of the carrier 105.

Turning to FIG. 11, the carrier 105 is shown loaded with containers C in the container-receiving spaces 115, 117, for example, manually or with a loading apparatus. As shown, the portions of the back panel 125*b* from which the divider flaps 183, 187 are separated and folded away from form openings or windows 119 (broadly, "first opening" or "second opening"), 121 (broadly, "first opening" or "second opening") to provide access into the container-receiving spaces 117 in the interior 114 of the carrier 105. The windows 119, 121 are discontinuities and/or voids in the back panel 125*b* such that the amount of material that forms the carrier 105 is reduced or optimized, for example, as compared to a carrier having panels that lack such windows. Additionally or alternatively, the windows 119, 121 can provide visibility to customers of a label or other portion of containers C disposed in the container-receiving spaces 117 for the purpose of conveying product information. The windows 119, 121 can also provide regions for inspection of the containers C, for example, to identify defects or for quality control, for example, prior to shipping, following shipping, and/or prior to placement of the carrier 105 in a retail location. It will be understood that the carrier 105 can include additional or fewer or windows, or a different arrangement of windows, without departing from the disclosure. For example, in one embodiment, windows 119, 121 can additionally or alternatively be provided on the front panel 125*a*.

Figure 12:
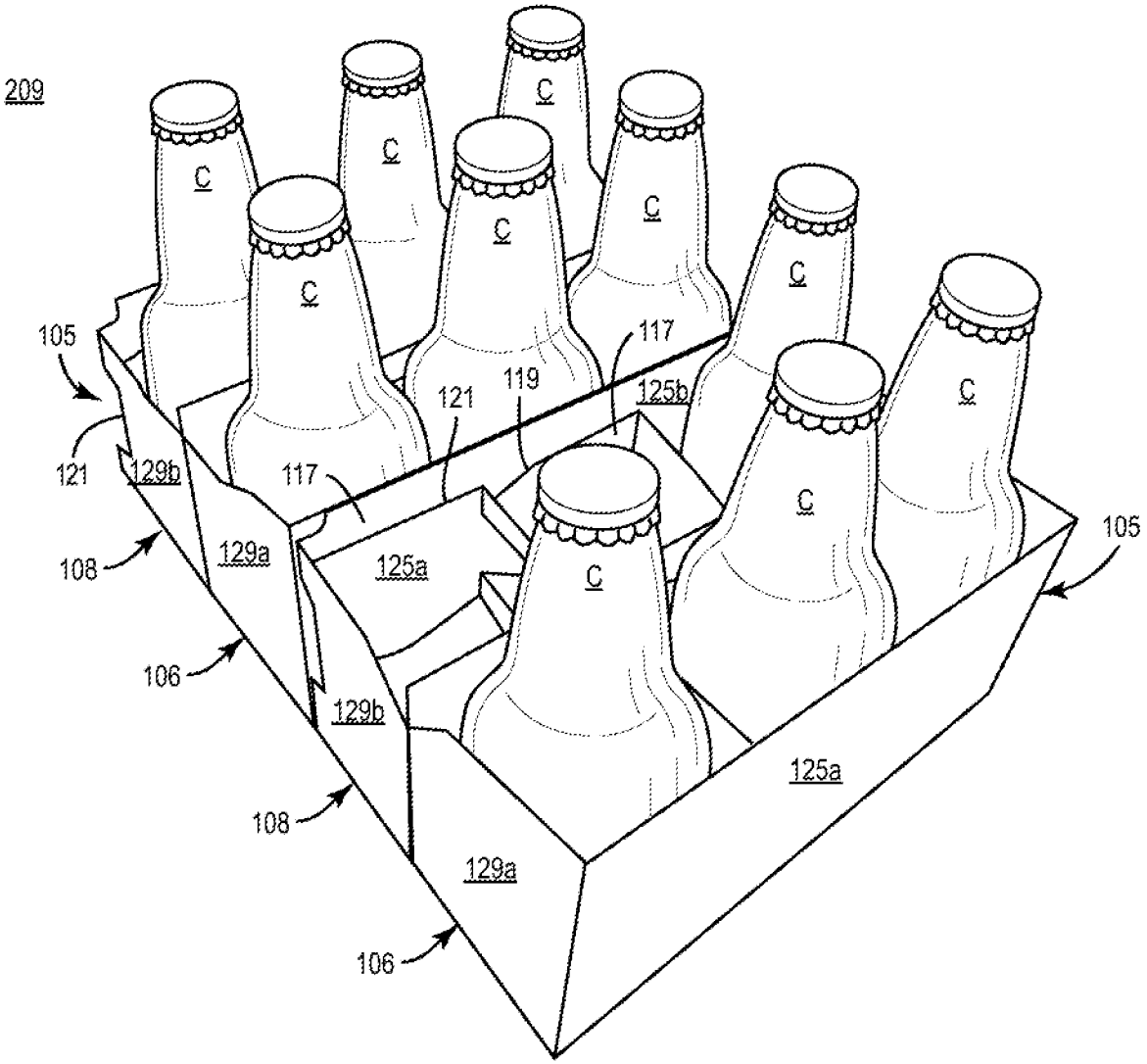
FIG. 12 is a perspective view of a system including a pair of the carriers of FIG. 11 in a side-by-side arrangement according to an exemplary embodiment of the disclosure.

Turning additionally to FIG. 12, the carriers 105 loaded with the containers C can be arranged for storage and/or transport as a carrier or insert system 209 that includes at least two carriers 105 in an abutting or side-by-side arrangement with a front panel 125*a* of one carrier 105 (broadly, "second carrier") in at least partial face-to-face contact with the back panel 125*b* of an adjacent carrier 105 (broadly, "first carrier"), as shown. In this regard, the windows 119, 121 in the back panel 125*b* of the first carrier 105 of the system 209 are covered, e.g., in at least partial face-to-face contact, by the front panel 125*a* of the adjacent second carrier 105 of the system 209 such that each front panel 125*a*, which is substantially devoid of windows or other openings, is shared by adjacent first and second carriers 105 in the system 209 to provide enhanced coverage and protection of containers C in the carriers 105, while allowing portions of the carriers 105 to retain windows 119, 121 for material-saving purposes and/or product visibility. While the system 209 is illustrated with two carriers 105, it will be understood that the system 209 can include greater than two carriers 105.

Referring additionally to FIG. 13, the system 209 can be used with an outer container or outer carton 211 having an interior 213 within which the two or more adjacent carriers 105 can be inserted in the side-by-side configuration described above. In this regard, the system 209 of carriers 105 can be inserted into the interior 213 of the outer carton 211, for example, manually or through the use of a conveyer or other transporting apparatus. In one embodiment, the notch 138 near the second side panels 129*a*, 129*b* can provide access to the second keel 140 and/or the central panel 147 to facilitate loading of the carriers 105 into the outer carton 211. In one embodiment, the system 209 includes the outer carton 211. It will be understood that one carrier 105 of the system 209 can have respective windows 119, 121 positioned in at least partial face to face contact with a side 215 of the outer carton 211 such that the side 215 of the outer carton 211 covers the windows 119, 121 for protection and/or visibility therethrough as described above.

In general, the blank may be constructed from paperboard having a caliper so that it is heavier and more rigid than ordinary paper. The blank can also be constructed of other materials, such as cardboard, or any other material having properties suitable for enabling the carrier to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding thereallong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding at least one container, the carrier comprising:

a plurality of panels extending at least partially around an interior of the carrier, the plurality of panels comprising a front panel, a back panel, at least one central panel, at least one side panel, and at least one bottom panel;

at least one divider flap foldably connected to one of the front panel and the back panel, the at least one divider flap folded away from the one of the front panel and the back panel to form at least one opening in the one of the front panel and the back panel, the at least one divider flap extends through the interior of the carrier to the at least one central panel, at least one of the front panel and the back panel comprises at least one notch at an upper edge thereof, the at least one notch provides an access path to a portion of the at least one central panel aligned with the at least one notch, the at least one central panel comprises a notch at an upper edge thereof, and, in a folded configuration of the carrier, the at least one notch and the notch of the at least one central panel are aligned such that the access path extends through the notch of the at least one central panel.

2. The carrier of claim 1, wherein the at least one opening provides access to the interior of the carrier.

3. The carrier of claim 1, wherein the at least one opening extends at least partially into the at least one side panel.

4. The carrier of claim 1, wherein the at least one divider flap is a first divider flap and the carrier further comprises a second divider flap foldably connected to the one of the front panel and the back panel, the second divider flap extends from the one of the front panel and the back panel to the at least one central panel, the at least one opening is a first opening, and the second divider flap is folded away from the one of the front panel and the back panel to form a second opening in the one of the front panel and the back panel.

5. The carrier of claim 4, wherein the first opening is in communication with the second opening.

6. The carrier of claim 5, wherein an attachment flap is foldably connected to each of the first divider flap and the second divider flap.

7. The carrier of claim 1, wherein the at least one side panel is a first front side panel and the plurality of panels further comprises a second front side panel, a first back side panel, and a second back side panel.

8. The carrier of claim 7, wherein the at least one divider flap is a first divider flap foldably connected to the back panel and the carrier further comprises a second divider flap foldably connected to the back panel and extending to the at least one central panel, the carrier further comprises a third divider flap and a fourth divider flap each foldably connected to the at least one central panel and extending to the front panel.

9. A carrier for holding at least one container, the carrier comprising:

a plurality of panels extending at least partially around an interior of the carrier, the plurality of panels comprising a front panel, a back panel, at least one central panel, at least one side panel, and at least one bottom panel;

at least one divider flap foldably connected to one of the front panel and the back panel, the at least one divider flap folded away from the one of the front panel and the back panel to form at least one opening in the one of the front panel and the back panel, the at least one divider flap extends through the interior of the carrier to the at least one central panel, at least one of the front panel and the back panel comprises at least one notch at an upper edge thereof, the at least one notch provides an access path to a portion of the at least one central panel aligned with the at least one notch, wherein the at least one notch is a first notch at an upper edge of the front panel and the access path is a first access path, and the back panel comprises a second notch at an upper edge thereof that provides a second access path to a portion of the at least one central panel aligned with the second notch, wherein the at least one central panel comprises a third notch at an upper edge thereof, and wherein in a folded configuration of the carrier, the first notch and the third notch are aligned such that the first access path extends through the third notch to a portion of the back panel.

10. The carrier of claim 9, wherein in the folded configuration of the carrier, the second notch and the third notch are aligned such that the second access path extends through the third notch to a portion of the front panel.

11. The carrier of claim 9, wherein the front panel comprises a fourth notch at an upper edge thereof, wherein in the folded configuration of the carrier the fourth notch provides a fourth access path to a portion of the central panel aligned with the fourth notch.

12. The carrier of claim 9, wherein the at least one side panel comprises a chamfer at an upper edge thereof, the chamfer is adjacent the at least one central panel such that the at least one central panel is exposed above the chamfer.

13. A blank for forming a carrier for holding at least one container, the blank comprising:

a plurality of panels for extending at least partially around an interior of the carrier formed from the blank, the plurality of panels comprising a front panel, a back panel, at least one central panel, at least one side panel, and at least one bottom panel, the blank further comprising at least one divider flap foldably connected to one of the front panel and the back panel, the at least one divider flap is for being folded away from the one of the front panel and the back panel to form at least one opening in the one of the front panel and the back panel in the carrier formed from the blank, the at least one divider flap extends through the interior of the carrier formed from the blank to the at least one central panel, at least one of the front panel and the back panel comprises at least one notch at an upper edge thereof, the at least one notch provides an access path to a portion of the at least one central panel aligned with the at least one notch in the carrier formed from the blank, the at least one central panel comprises a notch at an upper edge thereof, and, in a folded configuration of the carrier formed from the blank, the at least one notch and the notch of the at least one central panel are aligned such that the access path extends through the notch of the at least one central panel.

14. The blank of claim 13, wherein the at least one opening provides access to the interior of the carrier formed from the blank.

15. The blank of claim 13, wherein the at least one opening extends at least partially into the at least one side panel in the carrier formed from the blank.

16. The blank of claim 13, wherein the at least one divider flap is a first divider flap and the blank further comprises a second divider flap foldably connected to the one of the front panel and the back panel, the second divider flap extends from the one of the front panel and the back panel to the at least one central panel in the carrier formed from the blank, the at least one opening is a first opening in the carrier formed from the blank, and the second divider flap is folded away from the one of the front panel and the back panel to form a second opening in the one of the front panel and the back panel in the carrier formed from the blank.

17. The blank of claim 16, wherein the first opening is in communication with the second opening in the carrier formed from the blank.

18. The blank of claim 17, wherein an attachment flap is foldably connected to each of the first divider flap and the second divider flap.

19. The blank of claim 13, wherein the at least one side panel is a first front side panel and the plurality of panels further comprises a second front side panel, a first back side panel, and a second back side panel.

20. The blank of claim 19, wherein the at least one divider flap is a first divider flap foldably connected to the back panel and the blank further comprises a second divider flap foldably connected to the back panel, the blank further comprises a third divider flap and a fourth divider flap each foldably connected to the at least one central panel.

21. A blank for forming a carrier for holding at least one container, the blank comprising:

a plurality of panels for extending at least partially around an interior of the carrier formed from the blank, the plurality of panels comprising a front panel, a back panel, at least one central panel, at least one side panel, and at least one bottom panel, the blank further comprising at least one divider flap foldably connected to one of the front panel and the back panel, the at least one divider flap is for being folded away from the one of the front panel and the back panel to form at least one opening in the one of the front panel and the back panel in the carrier formed from the blank, the at least one divider flap extends through the interior of the carrier formed from the blank to the at least one central panel at least one of the front panel and the back panel comprises at least one notch at an upper edge thereof, the at least one notch provides an access path to a portion of the at least one central panel aligned with the at least one notch in the carrier formed from the blank, wherein the at least one notch is a first notch at an upper edge of the front panel and the access path is a first access path in the carrier formed from the blank, and the back panel comprises a second notch at an upper edge thereof that provides a second access path to a portion of the at least one central panel aligned with the second notch in the carrier formed from the blank, wherein the at least one central panel comprises a third notch at an upper edge thereof, and wherein in a folded configuration of the carrier formed from the blank, the first notch and the third notch are aligned such that the first access path extends through the third notch to a portion of the back panel.

22. The blank of claim 21, wherein in the folded configuration of the carrier formed from the blank, the second notch and the third notch are aligned such that the second access path extends through the third notch to a portion of the front panel.

23. The blank of claim 21, wherein the front panel comprises a fourth notch at an upper edge thereof, wherein in the folded configuration of the carrier formed from the blank the fourth notch provides a fourth access path to a portion of the central panel aligned with the fourth notch.

24. The blank of claim 21, wherein the at least one side panel comprises a chamfer at an upper edge thereof, the chamfer is adjacent the at least one central panel such that the at least one central panel is exposed above the chamfer.

25. A method of forming a carrier for holding at least one container, the carrier comprising:

obtaining a blank comprising a plurality of panels, the plurality of panels comprising a front panel, a back panel, at least one central panel, at least one side panel, and at least one bottom panel, the blank further comprising at least one divider flap foldably connected to one of the front panel and the back panel, at least one of the front panel and the back panel comprises at least one notch at an upper edge thereof, the at least one central panel comprises a notch at an upper edge thereof;

folding the plurality of panels at least partially around an interior of the blank such that the at least one notch provides an access path to a portion of the at least one central panel aligned with the at least one notch and such that the at least one notch and the notch of the at least one central panel are aligned so that the access path extends through the notch of the at least one central panel to a portion of the back panel; and folding the at least one divider flap away from the one of the front panel and the back panel to form at least one opening in the one of the front panel and the back panel and such that the at least one divider flap extends through the interior of the carrier to the at least one central panel.

26. The method of claim 25, wherein the at least one opening provides access to the interior of the carrier.

27. The method of claim 25, wherein the at least one opening extends at least partially into the at least one side panel.

28. The method of claim 25, wherein the at least one divider flap is a first divider flap and the carrier further comprises a second divider flap foldably connected to the one of the front panel and the back panel, the second divider flap extends from the one of the front panel and the back panel to the at least one central panel, the at least one opening is a first opening, and the second divider flap is folded away from the one of the front panel and the back panel to form a second opening in the one of the front panel and the back panel.

29. The method of claim 28, wherein the first opening is in communication with the second opening.

30. The method of claim 29, wherein an attachment flap is foldably connected to each of the first divider flap and the second divider flap.

31. The method of claim 25, wherein the at least one side panel is a first front side panel and the plurality of panels further comprises a second front side panel, a first back side panel, and a second back side panel.

32. The method of claim 31, wherein the at least one divider flap is a first divider flap foldably connected to the back panel and the carrier further comprises a second divider flap foldably connected to the back panel and extending to the at least one central panel, the carrier further comprises a third divider flap and a fourth divider flap each foldably connected to the at least one central panel and extending to the front panel.

33. A method of forming a carrier for holding at least one container, the carrier comprising:

obtaining a blank comprising a plurality of panels, the plurality of panels comprising a front panel, a back panel, at least one central panel, at least one side panel, and at least one bottom panel, the blank further comprising at least one divider flap foldably connected to one of the front panel and the back panel, at least one of the front panel and the back panel comprises at least one notch at an upper edge thereof;

folding the plurality of panels at least partially around an interior of the blank such that the at least one notch provides an access path to a portion of the at least one central panel aligned with the at least one notch; and folding the at least one divider flap away from the one of the front panel and the back panel to form at least one opening in the one of the front panel and the back panel and such that the at least one divider flap extends through the interior of the carrier to the at least one central panel, wherein the at least one notch is a first notch at an upper edge of the front panel and the access path is a first access path, and the back panel comprises a second notch at an upper edge thereof that provides a second access path to a portion of the at least one central panel aligned with the second notch, wherein the at least one central panel comprises a third notch at an upper edge thereof, and wherein in a folded configuration of the carrier, the first notch and the third notch are aligned such that the first access path extends through the third notch to a portion of the back panel.

34. The method of claim 33, wherein in the folded configuration of the carrier, the second notch and the third notch are aligned such that the second access path extends through the third notch to a portion of the front panel.

35. The method of claim 33, wherein the front panel comprises a fourth notch at an upper edge thereof, wherein in the folded configuration of the carrier the fourth notch provides a fourth access path to a portion of the central panel aligned with the fourth notch.

36. The method of claim 33, wherein the at least one side panel comprises a chamfer at an upper edge thereof, the chamfer is adjacent the at least one central panel such that the at least one central panel is exposed above the chamfer.

37. A system, comprising:

a first carrier comprising:

a plurality of panels extending at least partially around an interior of the first carrier, the plurality of panels comprising a front panel, a back panel, at least one central panel, at least one side panel, and at least one bottom panel; and at least one divider flap foldably connected to one of the front panel and the back panel, the at least one divider flap folded away from the one of the front panel and the back panel to form at least one opening in the one of the front panel and the back panel, the at least one divider flap extends through the interior of the first carrier to the at least one central panel, at least one of the front panel and the back panel comprises at least one notch at an upper edge thereof, the at least one notch provides an access path to a portion of the at least one central panel aligned with the at least one notch, the at least one central panel comprises a notch at an upper edge thereof, and, in a folded configuration of the first carrier, the at least one notch and the notch of the at least one central panel are aligned such that the access path extends through the notch of the at least one central panel; and a second carrier comprising a plurality of panels extending at least partially around an interior of the second carrier, at least one panel of the plurality of panels of the second carrier is positioned adjacent the one of the front panel and the back panel of the first carrier to cover the at least one opening of the first carrier.

38. The system of claim 37, wherein the at least one opening provides access to the interior of the first carrier.

39. The system of claim 37, wherein the at least one opening extends at least partially into the at least one side panel of the first carrier.

40. The system of claim 37, wherein the at least one divider flap is a first divider flap and the first carrier further comprises a second divider flap foldably connected to the one of the front panel and the back panel, the second divider flap extends from the one of the front panel and the back panel to the at least one central panel, the at least one opening is a first opening, and the second divider flap is folded away from the one of the front panel and the back panel to form a second opening in the one of the front panel and the back panel.

41. The system of claim 40, wherein the first opening is in communication with the second opening.

42. The system of claim 41, wherein an attachment flap is foldably connected to each of the first divider flap and the second divider flap.

43. The system of claim 37, wherein the at least one side panel is a first front side panel and the plurality of panels of the first carrier further comprises a second front side panel, a first back side panel, and a second back side panel.

44. The system of claim 43, wherein the at least one divider flap is a first divider flap foldably connected to the back panel and the first carrier further comprises a second divider flap foldably connected to the back panel and extending to the at least one central panel, the first carrier further comprises a third divider flap and a fourth divider flap each foldably connected to the at least one central panel and extending to the front panel.

45. A system, comprising:

a first carrier comprising:

a plurality of panels extending at least partially around an interior of the first carrier, the plurality of panels comprising a front panel, a back panel, at least one central panel, at least one side panel, and at least one bottom panel; and at least one divider flap foldably connected to one of the front panel and the back panel, the at least one divider flap folded away from the one of the front panel and the back panel to form at least one opening in the one of the front panel and the back panel, the at least one divider flap extends through the interior of the first carrier to the at least one central panel, at least one of the front panel and the back panel comprises at least one notch at an upper edge thereof, the at least one notch provides an access path to a portion of the at least one central panel aligned with the at least one notch, wherein the at least one notch is a first notch at an upper edge of the front panel and the access path is a first access path, and the back panel comprises a second notch at an upper edge thereof that provides a second access path to a portion of the at least one central panel aligned with the second notch, wherein the at least one central panel comprises a third notch at an upper edge thereof, and wherein in a folded configuration of the first carrier, the first notch and the third notch are aligned such that the first access path extends through the third notch to a portion of the back panel; and a second carrier comprising a plurality of panels extending at least partially around an interior of the second carrier, at least one panel of the plurality of panels of the second carrier is positioned adjacent the one of the front panel and the back panel of the first carrier to cover the at least one opening of the first carrier.

46. The system of claim 45, wherein in the folded configuration of the first carrier, the second notch and the third notch are aligned such that the second access path extends through the third notch to a portion of the front panel.

47. The system of claim 45, wherein the front panel comprises a fourth notch at an upper edge thereof, wherein in the folded configuration of the first carrier the fourth notch provides a fourth access path to a portion of the central panel aligned with the fourth notch.

48. The system of claim 45, wherein the at least one side panel comprises a chamfer at an upper edge thereof, the chamfer is adjacent the at least one central panel such that the at least one central panel is exposed above the chamfer.

49. The system of claim 37, wherein the plurality of panels of the second carrier comprises a front panel, a back panel, at least one central panel, at least one side panel, and at least one bottom panel, and at least one divider flap is foldably connected to one of the front panel and the back panel of the second carrier, the at least one divider flap of the second carrier is folded away from the one of the front panel and the back panel of the second carrier to form at least one opening in the one of the front panel and the back panel of the second carrier, the at least one divider flap of the second carrier extends through the interior of the second carrier to the at least one central panel of the second carrier, the system further comprises an outer carton and the first carrier and the second carrier are at least partially inserted into an interior of the outer carton, the at least one opening of the second carrier is positioned adjacent a portion of the outer carton such that the portion of the outer carton covers the at least one opening of the second carrier.

* * * * *